US006131200A

United States Patent [19]

McNamara

[11] Patent Number: 6,131,200

[45] Date of Patent: Oct. 17, 2000

[54] SIMPLIFIED TIE RESTRAINT

[76] Inventor: Brian L. McNamara, 54 Arena Ter., Concord, Mass. 01742

[21] Appl. No.: 09/106,781

[22] Filed: Jun. 30, 1998

Related U.S. Application Data

[63] Continuation-in-part of application No. 08/866,465, May 30, 1997.

[51] Int. Cl.[7] ..... A41F 17/00

[52] U.S. Cl. ..... 2/144; 2/145; 24/49 R

[58] Field of Search ..... 2/145, 144, 146, 2/147, 148, 149, 150, 151, 152.1, 153, 52; 24/49 R, 16 PB, 30.5 P, 49 CF, 58, 50, 56; 383/71

[56] References Cited

U.S. PATENT DOCUMENTS

| | | | |
|---|---|---|---|
| 2,652,569 | 9/1953 | Confino | 2/145 |
| 3,913,179 | 10/1975 | Rhee | 24/16 PB |
| 3,997,943 | 12/1976 | Jones et al. | 24/30.5 |
| 4,466,159 | 8/1984 | Burrage | 24/16 PB |
| 5,353,438 | 10/1994 | Voiles | 2/145 |

*Primary Examiner*—Gloria M. Hale
*Attorney, Agent, or Firm*—Mark P. White

[57] ABSTRACT

An invisible tie restraint replaces the standard tie tack or tie bar for restraining a necktie onto a shirt or blouse front. The restraint is simple and inexpensive, being made of a single piece of flat treated cloth, paper or plastic. In one embodiment he restraint comprises an upper end, a lower end, and a body connecting the two ends, the body containing a multiplicity of notch pairs. The lower end contains a loop entry into which the upper end is inserted, drawing the body through until one of the notch pairs reaches a "stop" position while capturing the label of the necktie within the looped formed thereby. The restraint is attached to the shirt front by attaching a shirt button into a button hole formed in the upper end of the restraint. In other embodiments the restraint takes the form of a modified label, the label having a tab into which the button hole is formed.

8 Claims, 5 Drawing Sheets

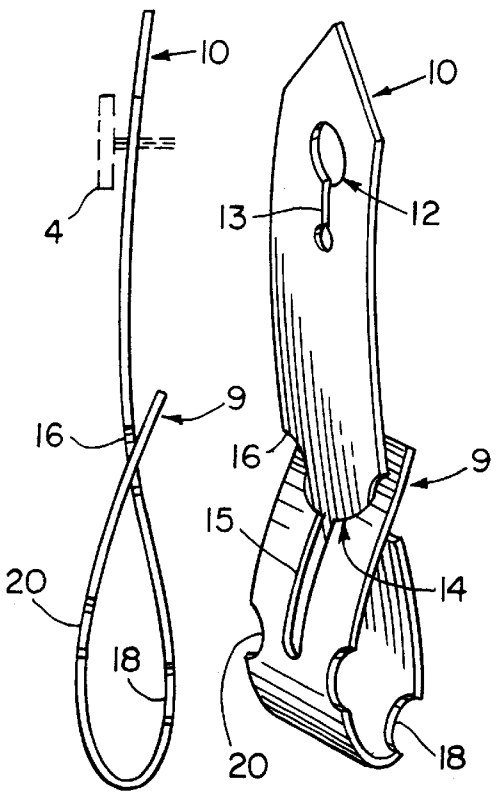
FIG. 5
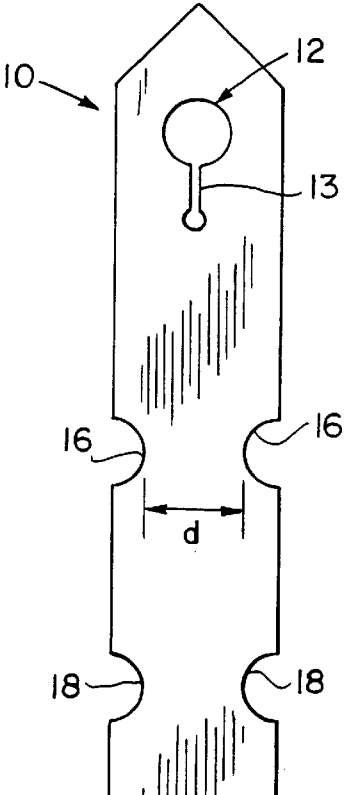
FIG. 4
FIG. 3

SIMPLIFIED TIE RESTRAINT

This application is a continuation in part of application Ser. No. 08/866,465 filed on May 30, 1997.

BACKGROUND OF THE INVENTION

1. Field of the Invention

The present invention relates to tie restrains, and more specifically to tie restrains which are not visible when the wearer is viewed from the front.

2. Description Relative to the Prior Art

Restraints for neck-ties or cravats worn by men, and occasionally by women, are well known. Tie bars, tie clips, studs which pierce the tie, and the like have been used for many years.

The tie bar or tie clip usually contains an ornamental decoration on the front, so that an observer will view the decoration which appears as fastened to the tie. The obverse side of the tie bar is usually fastened to the front of the shirt, so that the tie is thus restrained to conform to the desired position, that is, in a vertical line centered over the front shirt buttons, and held close to the wearer's body.

The tie stud operates in a similar fashion. The stud generally comprises a stud head, stud pin, and pin clasp. The stud pin generally pierces the tie, and the tie is held fast between the stud head and the pin clasp. The stud is usually connected to the shirt beneath by a chain or clip which is itself attached to the shirt front, shirt button, or to the shirt button hole directly beneath the stud.

Both the bar and the stud work in similar ways. The stud has the disadvantage of piercing the tie, but it is less obtrusive than the bar, since the stud head may be as small as desired, so long as the head is larger in diameter than the pin. However, both the bar and stud tend to distort or flatten the tie, and constrain the tie to the shirt, resulting in a somewhat unnatural appearance.

The current invention has several advantages over the prior art. First of all, the current invention avoids the unnatural appearance of the tie tack or pin, resulting in a look similar to the absence of a tie restraint. Nevertheless, the present invention maintains the tie in a neat, centered position, while preventing the tie from flapping or becoming entangled in the surrounding clothing. Furthermore, when using the present invention the tie restraint will always be invisible to the observer facing the wearer of the tie.

Thus, it is useless to make the current tie restraint out of expensive materials, and, in fact, the cost of the present invention will be measured in cents, rather than dollars. The current tie restraint is made of an inexpensive material, typically either cloth, plastic, or paper. In one of the preferred embodiments, the material is sufficiently thin and resilient so that the tie will lie very close to the shirt, yet the restraint will allow the tie to maintain its shape and dimensions while being worn.

In other embodiments the invention takes the form of a modified label, permanently attached to the tie, and containing a button hole into which one of the buttons of the wearer's shirt front may be inserted.

Because of the low cost of this invention, it may be provided free by shirt manufacturers, tie manufacturers, or store owners. The current tie restraint may be used to contain advertising for the supplier, or anyone else, for that matter.

SUMMARY OF THE INVENTION

A general object of the current invention is to provide a simple, low cost, tie restraint. A specific object of the current invention is to provide said tie restraint in a form which will be invisible to the viewer.

A further specific object of the current invention is to provide such a tie restraint which does not distort or constrain the tie, providing a natural appearance.

According to one aspect of the invention, the invention comprises a neck-tie restraint for securing a necktie having a label to a shirt button, said restraint formed of a thin, resilient material. The invention comprises an upper part, into which a button hole has been formed, a lower part, into which a loop entry has been formed and a body connecting the upper and lower parts. When the restraint is inserted between the label and the necktie, the upper part is looped around the label and inserted into the loop entry. The label is thus captured within this loop, and the shirt button inserted into the button hole.

According to another aspect of the invention the loop entry is in the shape of a circular hole connected to a slot extending from the circle toward the upper part of the restraint. The dimensions of the hole are such that the upper part may be drawn through the loop entry.

According to still another aspect of the invention the body of the restraint contains a multiplicity of notch pairs. The dimensions of these notches is such that when the body is inserted through the loop entry at the location of a notch pair the body "stopped" from moving relative to the loop entry.

According to a final aspect of the invention the restraint button hole is formed into the shape of a circular hole connected to a slot extending from the circle toward the lower part.

BRIEF DESCRIPTION OF THE DRAWINGS

These, and further features of the invention, may be better understood with reference to the accompanying specification and drawings depicting the preferred embodiment, in which:

FIG. 3 depicts a plan view of the first preferred embodiment of the tie restraint as viewed from the either the front or rear.

FIG. 4 depicts a side elevation of the first preferred embodiment of the tie restraint formed into a loop, with the shirt button attached, wherein the left and right views are mirror images.

FIG. 5 depicts a perspective view of the first preferred embodiment of the tie restraint formed into a loop.

DETAILED DESCRIPTION OF THE PREFERRED EMBODIMENTS

FIRST PREFERRED EMBODIMENT

Figure 1:
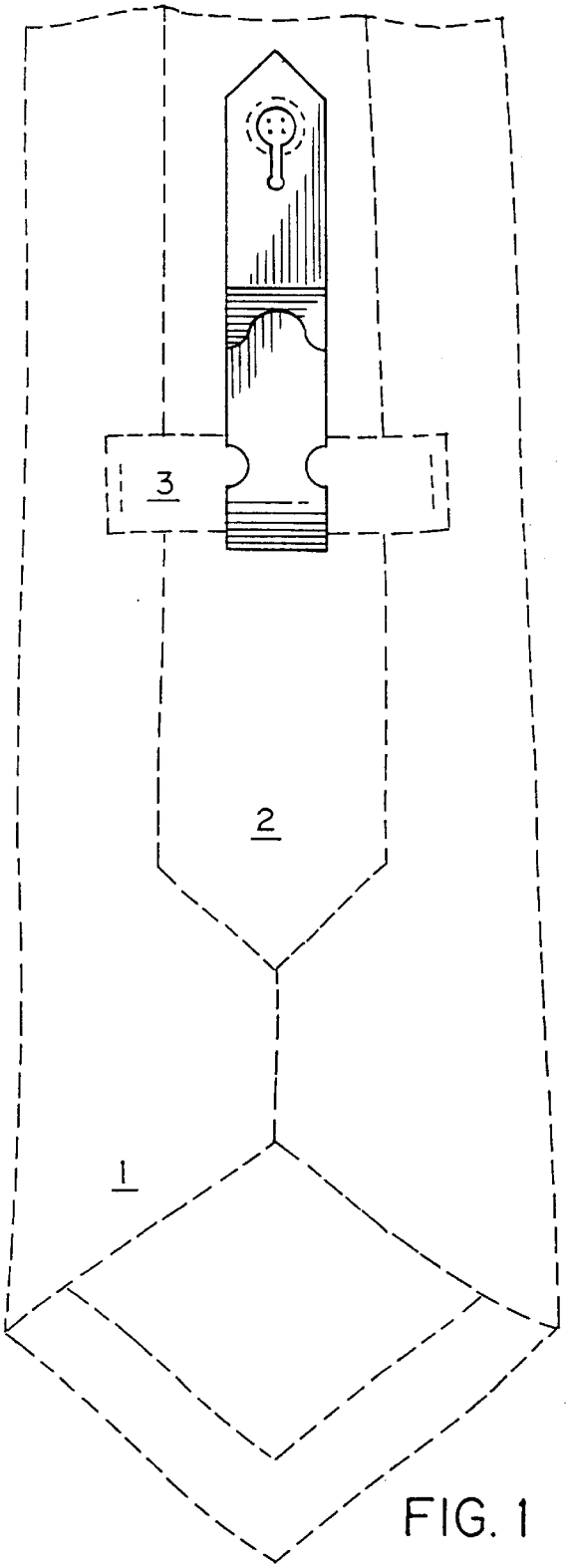
FIG. 1 depicts the first preferred embodiment of the tie restraint attached to a tie, as seen from the back, or shirt side, of the tie.

The first preferred embodiment may be understood by first referring to FIG. 1, which depicts the invention as viewed from the back, or wearer side, of the tie.

In the drawing of FIG. 1, the tie comprises a major end 1, a minor end 2, and a label 3 attached at either end laterally to the minor end, permitting the minor end to be led through the space between the major end and the label, thereby keeping the minor aligned with, and centered on the major end, so that the minor end is generally not visible when the tie is viewed when facing the wearer. The use of the label to so constrain the minor end is a very common, but not universal, use of said label.

Figure 2:
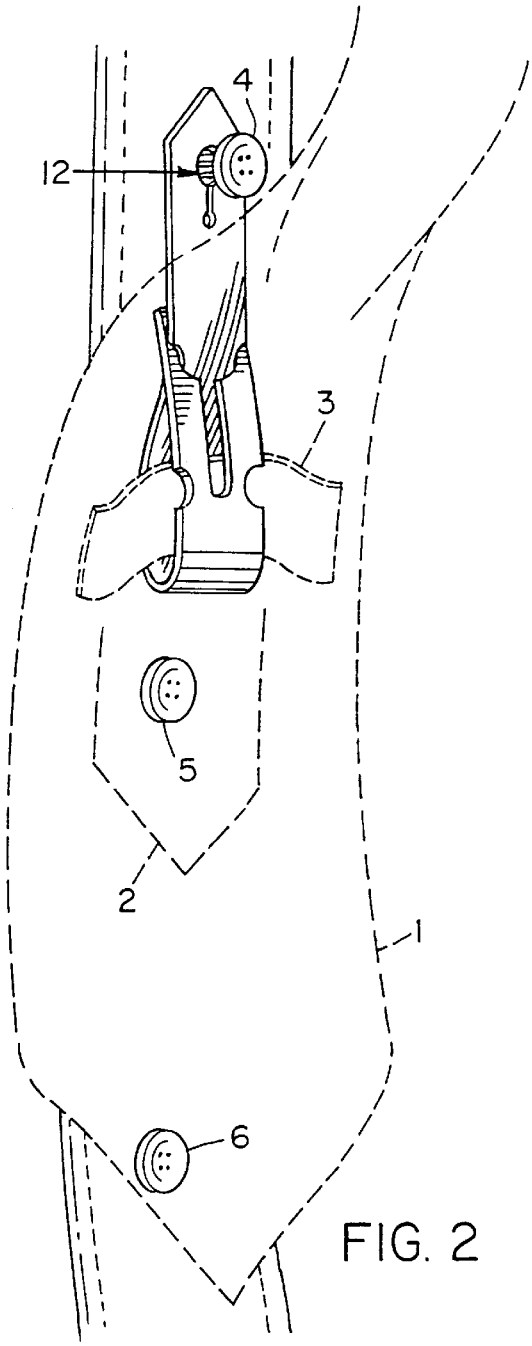
FIG. 2 depicts a perspective view of the first preferred embodiment of the tie restraint attached to a tie, as seen from the front of the tie.

FIG. 2 shows the tie from the same viewpoint, except that in FIG. 2 the upper part of the tie is displaced to the right, so that the upper part of the tie restraint is visible, and the tie restraint is shown in a perspective view. In FIG. 2 the buttons 4, 5, and 6 of the shirt front are depicted, and button 4 is affixed to the restraint button hole 12 of the tie restraint, while the lower end of the tie restraint forms a loop, capturing the tie label thereby.

FIG. 3 shows the tie restraint laid flat. The restraint is made of a thin, resilient treated paper, plastic, or similar material. In the first preferred embodiment the material is 0.030 inches thick. The material must exhibit a degree of stiffness, so that the resulting tie restraint does not simply collapse, as it would if made of cotton cloth. It is important that the restraint maintain its loop size, and maintain the distance between the shirt button and the bottom of the loop.

The restraint comprises an upper part, 10, through which the restraint button hole 12 has been formed, and a lower part 9, through which the loop entry 14 has been formed. The bottom of the restraint button hole further comprises the upper slot 13, which facilitates the entry of the button to which the restraint is attached when in use, as seen in FIG. 4.

In a similar manner, the upper part of the loop entry further comprises the lower slot 15, which facilitates the forming of the loop when the upper part is inserted into the loop entry.

In the body formed between the upper and lower parts of the restraint there appear three sets of notches: the upper notches, 16, middle notches 18, and lower notches 20. The dimensions of the loop entry are such that the upper end of the restraint may be completely inserted into the loop entry when the upper end is slightly flexed. In addition, however, the diameter of the loop entry is more or less the same as dimension "d" of FIG. 3, that is, the width of the restraint from the inside of one notch to the inside of the closest adjacent notch.

Thus in forming the loop as shown in FIG. 5, the restraint is slid between the label and the minor end of the tie, with the upper end of the restraint pointed downwards toward the floor. The upper part of the restraint is then pulled upward around the label and then through the loop entry, forming a loop around the label. The upper part of the restraint is pulled through until one of the notch pairs appears within the loop entry. The upper part is then rotated 90 degrees, so that notches are captured within the loop entry, as seen in FIG. 5. Finally, the nearest shirt front button is pushed through the restraint button hole, capturing the button with said restraint button hole.

If the material of the restraint is sufficiently rigid and resilient, the restraint will be effectively "locked" into position when a notch pair is thus captured or "stopped" within the loop entry. If the material is too soft, however, the notch pairs will not serve their function, and the body of the restraint will slide freely through the loop entry despite the presence of the notch pairs, thus defeating the purpose of the notches. By providing three sets of notches the restraint is given a degree of adjustablility, so that the distance from the label to the nearest shirt front button is not critical to the operation of the restraint.

In the first preferred embodiment, the upper part is formed into a "V"-shape, facilitating the insertion of the upper part into the loop entry. In the preferred embodiment the restraint is formed from a piece of material of uniform width. This embodiment teaches an optimum restraint length of 4⅝ inches, an optimum width of ⅝ inches, and a thickness of 0.030 inches.

In alternative embodiments, the restraint button hole may comprise a simple elongated slot. However, it is felt that the slot-circular-hole combination provides easier insertion of the button.

A second alternative embodiment uses v-shaped notches in place of the semi circular notches shown in FIG. 3. It is felt that the semi-circular notches provide superior wear resistance, since v-shaped notches are more likely to tear.

SECOND PREFERRED EMBODIMENT—THE TEE-LABEL

Figure 6:
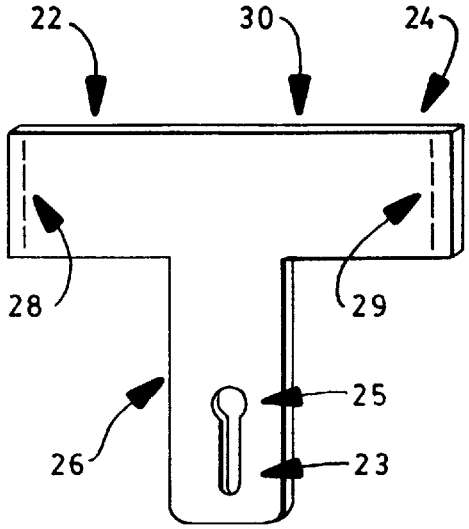
FIG. 6 depicts a plan view of the second preferred embodiment of the tie restraint, in the form of a tee-shaped label.

The "tee" label restraint may be understood by referring to FIG. 6, which shows a tie restraint in the shape of a "tee", having an left cross arm 22 and right cross arm 24, and a central tab 26, into the bottom of which the restraint button hole 25 is formed. As in the first preferred embodiment, this button hole further includes an upper slot 23, which facilitates the entry of the button to which the restraint is attached when in use.

The "tee" label embodiment is attached to the tie by sewing at left attachment line 28 and right attachment line 29, forming a central loop 30 through which the minor end 2 of the tie is inserted, similar to the way the minor end is normally inserted into the prior art label, as shown in FIGS. 1 and 2. After inserting the minor end into the "tee" label, the restraint in attached to the shirt by inserting the shirt button into the button hole 25.

Figure 9:
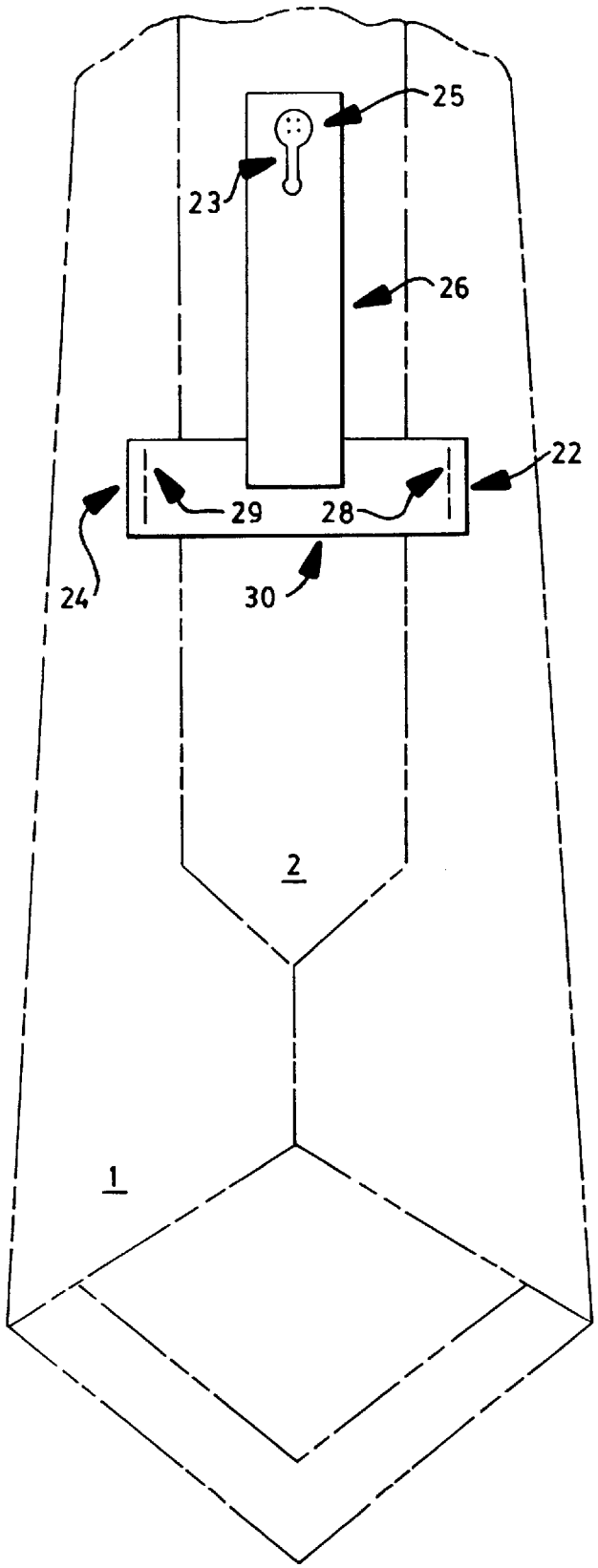
FIG. 9 depicts the second preferred embodiment of the tie restraint in use, as seen from the back, or shirt side, of the tie.

FIG. 9 depicts the tee-label restraint as worn with a tie. It may be seen by referring to FIG. 9 that the minor end o the tie 2 passes between the major end of the tie 1 and the central loop 30 formed when the restrain is sewn onto the tie at lines 28 and 29.

FIG. 9 depicts the tee-label restraint sewn onto the tie so that the central tab 26 is oriented upward in the figure, or toward the neck of the wearer. However, the tee-label restraint may be sewn onto the tie with the central tab pointing down in the figure, or away from the neck of the wearer, as well, and with equal efficacy.

It should be apparent that the "tee" label embodiment does not require the rigidity of the first preferred embodiment, because of the way the tee-label is sewn onto the tie. It has been found that he tee-label may be formed of cloth, of the same general type as is currently used for tie labels. Thus, the tee-label differs from currently used tie labels only in shape, and can be adopted by tie manufacturers as the standard label without significantly increasing cost or complexity of manufacture.

THIRD PREFERRED EMBODIMENT—THE LOOP-LABEL

Figure 7:
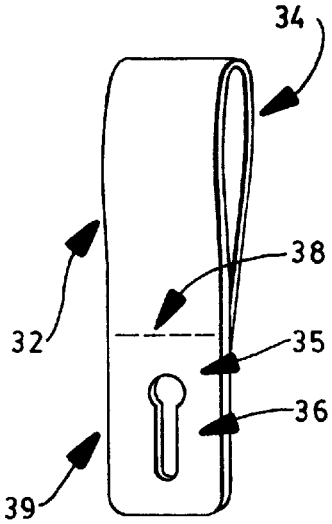
FIG. 7 depicts a plan view of the third preferred embodiment of the tie restraint, in the form of a loop-shaped label.

The loop-label restraint may be understood by referring to FIG. 7. This embodiment of the restraint is formed of a single, essentially rectangular section of cloth, which is folded back on itself to form a front arm 32, and a rear loop

34. The rear loop is attached at its end to the front tab by sewing at attachment line 38, leaving front tab 39 extending downward from the loop so formed. Buttonhole 35 is formed into the front tab, and, as in the other embodiments, upper slot 36 facilitate entry of the shirt button into the button hole.

The loop-label is used together with the standard tie label, as shown in FIGS. 1 and 2, by forming the label loop around the standard tie label, capturing the standard label therein, as shown in FIG. 9. The loop-label may therefore be used by tie manufacturers to modify ties already manufactured. Like the tee-label restraint, the loop-label restrain may also be made of cloth, which is thought to be the best material for this embodiment.

FOURTH PREFERRED EMBODIMENT—THE TAB-LABEL

Figure 8:
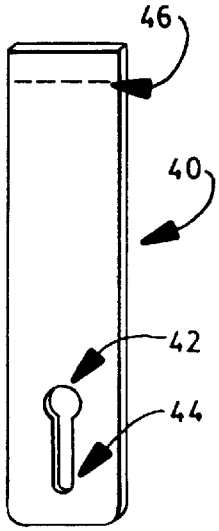
FIG. 8 depicts a plan view of the fourth preferred embodiment of the tie restraint, in the form of a tab-shaped label.

The tab-label restraint may be understood by referring to FIG. 8. This embodiment of the restraint is formed of a single, essentially rectangular section of cloth making up the body 40, into which buttonhole 46 is formed to facilitate entry of the shirt button into the button hole. The tab-label restrain may be attached either directly to the tie, or to an existing tie label, by sewing at line 46. Thus, the tab-label restraint may be used instead of a standard tie label, or in addition to the standard tie label.

Figure 10:
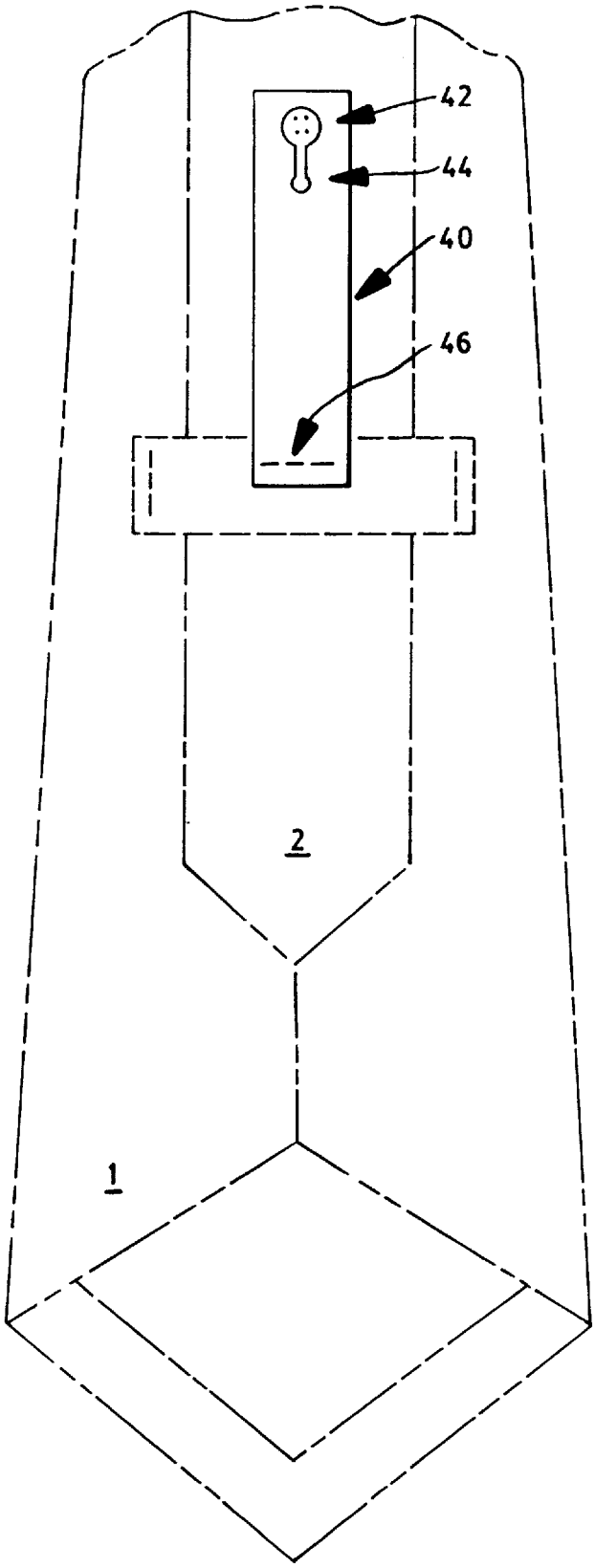
FIG. 10 depicts the fourth preferred embodiment of the tie restraint in use, as seen from the back, or shirt side, of the tie.

FIG. 10 depicts the tee-label restraint as worn with a tie. It may be seen by referring to FIG. 10 that the tab-restrain is sewn onto the label at line 46.

FIG. 10 depicts the tee-label restraint sewn onto the tie so that the body 26 is oriented with the buttonhole 42 upward in the figure, or toward the neck of the wearer. However, the tab-label restraint may be sewn onto the tie with the buttonhole pointing down in the figure, or away from the neck of the wearer, as well, and with equal efficacy.

While the invention has been described with reference to specific embodiments, it will be apparent that improvements and modifications may be made within the purview of the invention without departing from the scope of the invention defined in the appended claims.

I claim:

1. A method for securing a necktie having a label to a shirt button comprising:

using a restraint formed of a thin, resilient material, said restraint having a length and a width, and comprising:

an upper part, into which a button hole has been formed into the shape of a circular hole connected to a slot extending from the circular hole;

a lower part, into which a loop entry has been formed in the shape of a circular hole connected to a slot extending from the circular hole; and a body, containing a multiplicity of notch pairs, said body connecting the upper and lower parts, inserting the restraint between the label and the necktie;

looping the upper part around the label;

inserting the upper part into the loop entry at the location of a notch pair, thereby capturing the label; and inserting the shirt button into the button hole.

2. The method of claim 1, wherein the upper part is formed into a "V" shape.

3. The restraint method of claim 2, wherein the width of the restraint is uniform throughout the length of the restraint.

4. The restraint method of claim 3, wherein the material is selected from the group consisting of paper, plastic, and cloth.

5. The restraint method of claim 4, wherein the number of notch pairs is three.

6. A method for securing a necktie to a shirt button comprising:

using a restraint formed of a thin, resilient, material, said restraint having a length and a width and comprising:

an upper part, into which a button hole has been formed into the shape of a circular hole connected to a slot extending from the circular hole; a lower part, into which a loop entry has been formed in the shape of a circular hole connected to a slot extending from the circular hole; and a body, containing a multiplicity of notch pairs said body connecting the upper and lower parts, inserting the restraint between the label and the nectie;

looping the upper part around the label; and inserting the shirt button into the button hole.

7. A method for securing a neck-tie having a label to a shirt button, comprising:

using a restraint comprising:

a single piece of substantially rectangular material having two ends, doubled back upon itself to form a loop, the ends being affixed to one another; and a tab affixed to the loop into which into which a button hole has been formed into the shape of a circular hole connected to a slot extending from the circular hole, forming the loop about the label capturing the label thereby, and inserting said button in said button hole.

8. A method for securing a neck-tic to a shirt button, comprising using a restraint, comprising:

a single piece of substantially rectangular material, having an upper end and a lower end, a button hole having been formed in the lower end into the shape of a circular hole connected to a slot extending from the circular hole;

permanently fastening the restraint to the tie; and inserting said button in said button hole.

* * * * *